US005797225A

United States Patent [19]

Ishikawa

[11] Patent Number: 5,797,225

[45] Date of Patent: Aug. 25, 1998

[54] SLOPED ROOF AND HEAD

[75] Inventor: Masayoshi Ishikawa, Dublin, Ga.

[73] Assignee: YKK Corporation of America, Lyndhurst, N.J.

[21] Appl. No.: 823,906

[22] Filed: Mar. 25, 1997

Related U.S. Application Data

[63] Continuation of Ser. No. 377,011, Jan. 23, 1995, abandoned.

[51] Int. Cl.[6] ..... E04B 7/04

[52] U.S. Cl. ..... 52/93.1; 52/200; 52/209; 52/277; 52/280; 52/204.57

[58] Field of Search ..... 52/90.1, 93.1, 52/200, 204.57, 209, 280, 277

[56] References Cited

U.S. PATENT DOCUMENTS

| | | | |
|---|---|---|---|
| 4,070,806 | 1/1978 | Hubbard | 52/95 |
| 4,100,704 | 7/1978 | Oogami | 52/277 |
| 4,114,330 | 9/1978 | Sukolics | 52/200 |
| 4,296,576 | 10/1981 | Rice, Jr. et al. | 52/90 |
| 4,327,532 | 5/1982 | Matthews | 52/92 |
| 4,680,905 | 7/1987 | Rockar | 52/200 |
| 4,683,693 | 8/1987 | Rockar et al. | 52/198 |
| 4,998,389 | 3/1991 | Pritts | 52/90 |

*Primary Examiner*—Christopher Kent
*Assistant Examiner*—Yvonne Horton-Richardson
*Attorney, Agent, or Firm*—Finnegan, Henderson, Farabow, Garrett & Dunner, L.L.P.

[57] ABSTRACT

A sloped roof is supported on a horizontal upper surface of a support structure which has a trough on the upper surface. The sloped roof comprising two rafters disposed slant and extending substantially coplanar with each other, each rafter including a rafter gutter extending longitudinally thereof; two purlins each extending between the rafters to thus provide a plurality of openings, each purlin including a purlin gutter extending longitudinally thereof; a plurality of glazing panels fitted into the openings; and means for joining lower ends of the rafters to the horizontal upper surface of the support structure. The lower ends of the rafter gutters are exposed over the trough so that rain infiltrated into the sloped roof and water condensed on the underside of the glazing panels can be drained smoothly into the trough.

5 Claims, 6 Drawing Sheets

SLOPED ROOF AND HEAD

This application is a continuation of application Ser. No. 08/377,011, filed Jan. 23, 1995, now abandoned.

BACKGROUND OF THE INVENTION

1. Field of the Invention

The present invention relates generally to a slope roof for buildings and the like, and more particularly to a sloped roof comprising rafters and purlins interconnected with each other to support glazing panels, the rafters and purlins being constructed in such a way as to effectively discharge rain infiltrated the seal and water condensed on the inner side of the glazing panels.

2. Description of the Prior Art

A typical sloped roof of the type described is disclosed in U.S. Pat. No. 4070806. The disclosed sloped roof includes a structural framework comprising a plurality of sloping rafters which are cut at their lower ends and are butt fitted against an elongated baffle. The baffle is interlocked with the head of a vertical window frame. The framework includes a plurality of horizontal purlins interconnected at opposite ends to the rafters intermediate their ends. The rafters, baffle and purlins are each formed with longitudinally extending glazing channels or pockets adjacent to the upper portions thereof in order to support and receive the edges of glazing panels. The rafters and purlins have their respective gutters formed therein and are so interconnected with each other to permit rain and condensed water collected in the purlin gutters to be drained through rafter gutters then through weep holes formed in the baffles.

However, this conventional sloped roof suffers from drawbacks. The baffle must be formed with weep holes in strict registry with the gutters of rafters. Furthermore, if the roof and hence, the rafter are sloped at a different angle, a baffle of a different shape must be provided so as to enable it to be butt fitted with the lower end of the rafters. Still furthermore, in order to support the load of sloped roof, a strut is interconnected with the end of each rafter and the head of the vertical window frame. In addition to the weep holes, holes to insert the struts through must be formed in registry with the lower end of the rafters. It is very difficult if not impossible to form the weep holes and the strut holes in registry with the lower ends of the rafters. If the intervals between adjacent rafters are changed, then a different baffle having weep holes and strut holes formed at different intervals must be provided.

Since the weep holes formed in the baffle are small, something extraneous in rain like soil or dirt is liable to clog the weep holes, so that a problem with drainage may occur.

SUMMARY OF THE INVENTION

With the foregoing difficulties in view, it is therefore an object of the present invention to provide a sloped roof which dispense with a baffle so that the construction is simple and the manufacturing cost is less expensive; and the installing operation is simple; and furthermore, drainage can be smoothly made.

According to the present invention, there is provided a sloped roof supported adjacent to its lower end on a support structure, the support structure having a trough, the sloped roof comprising:

two rafters disposed at an angle and extending substantially coplanar with each other, each rafter including a rafter gutter extending longitudinally thereof;

two purlins each extending between the rafters to thus provide a plurality of openings, each purlin including a purlin gutter extending longitudinally thereof; the purlins and the rafters being interconnected in such a way to cause the purlin gutters to communicate with the rafter gutters;

a plurality of glazing panels fitted into the openings; and means for joining lower ends of the rafters to the support structure, the lower end of the gutter being fully exposed over the trough of the support structure.

According to another aspect of the invention, a lowermost purlin may be joined at its opposed ends with the lower ends of the rafters, the sloped roof further including an elongated cover plate joining the lowermost purlin and the support structure and extending throughout the entire width of the sloped roof to conceal the lower ends of the rafters and the joining means.

Many other advantages and features of the present invention will become manifest to those versed in the art upon making reference to the detailed description and the accompanying sheets of drawings in which preferred structure embodiments incorporating the principles of the present invention are shown by way of illustrative example.

DETAILED DESCRIPTION

Figure 1:
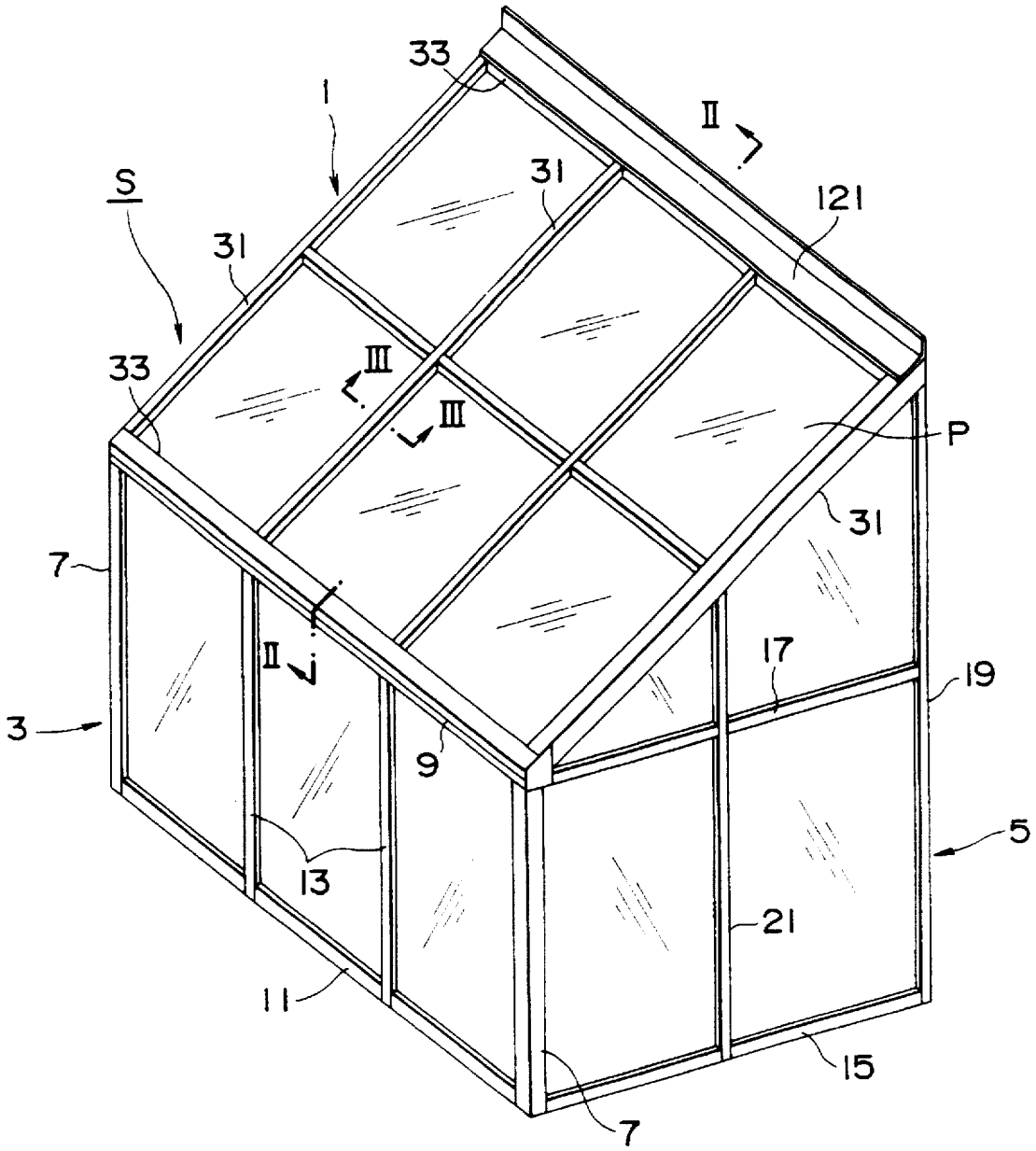
FIG. 1 is a perspective view of a solarium which incorporates a sloped roof according to the present invention.

FIG. 1 shows a solarium S installed at the top of a building (not shown) so as to obtain maximum sunshine in which solarium a sloped roof 1 according to this invention is used. In addition to the sloped roof 1, the solarium S includes a front frame 3 and a pair of side frames 5 (only one frame is seen in FIG. 1) to constitute a support structure to put the sloped roof 1 upon.

The front frame 3 is comprised of a pair of front jambs 7 and a head 9 and a sill 11 joined at their respective ends with the tipper ends and the lower ends of the front jambs 7 to provide the rectangular front frame 3. Two mullions 13, 13 are joined at their respect ends with the head 9 and sill 11 at their intermediate positions to provide glazing openings.

Each side frame 5 includes a side sill 15, an intermediate rail 17, a rear jamb 19 and a side mullion 21, which, are interconnected with the corresponding front jamb 7 and a corresponding rafter 31—closely described hereinafter—to thus compose a trapezoidal side frame 5 and to provide a plurality of glazing openings. The rear jamb 19 is fastened to a skeleton frame of a building by using suitable fastening means such as angle anchors, bolts and nuts (not shown). A plurality of glazing panels P are fitted into the glazing openings of the front frame and side frames. Because the constructions of the front frame 3 and the side frames 5 are well known in this technical field and do not constitute an essential part of this invention, no further explanation thereon will be made here, except for the front head 9 of the front frame 3, which will be described hereinafter.

Although the support structure for the sloped roof 1 is shown to be glazed frame here, it is not necessarily limited thereto. The support structure may be a wall made of brick or stone or a wall made of lumber, although a glazed frame provides the greatest amount of sun light.

As shown in FIG. 1, four parallel spaced rafters 31 and three parallel spaced purlins 33 are interconnected with each other to thus provide a sloped roof frame and six glazing openings. The glazing panels P are fitted into the glazing panels P.

Figure 3:
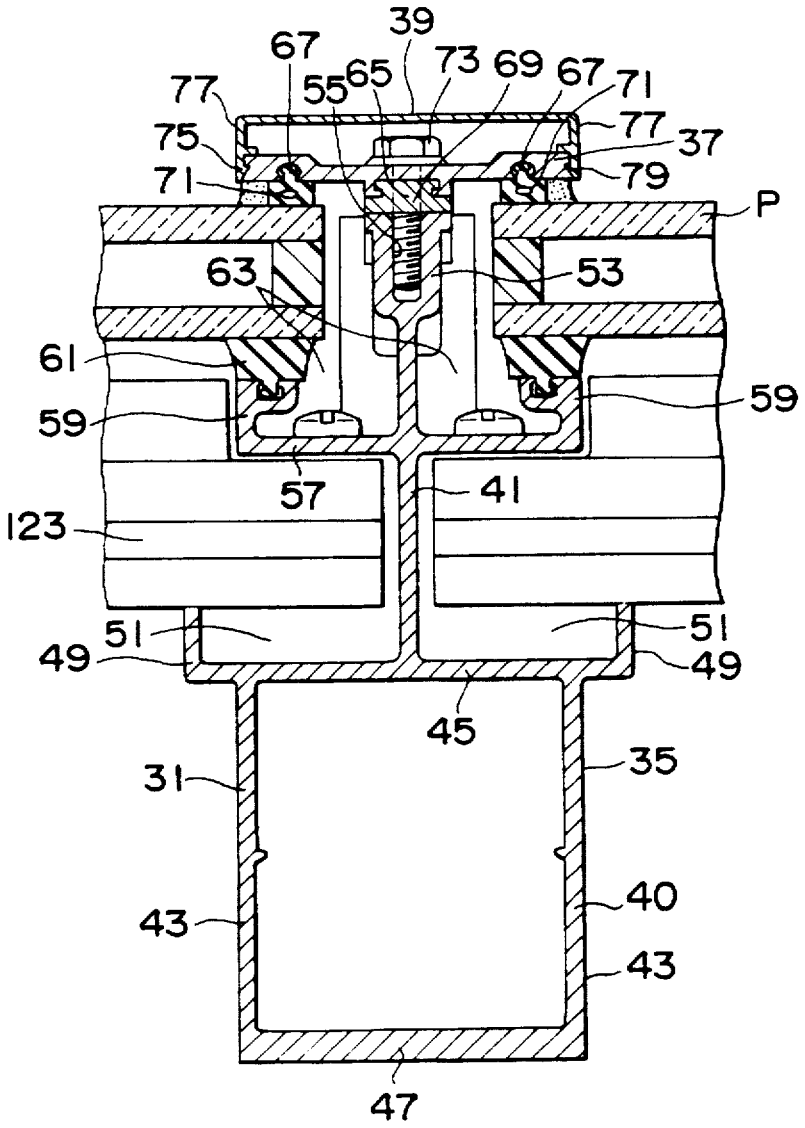
FIG. 3 is an enlarged cross-sectional view taken on line III—III of FIG. 1.
Figure 4:
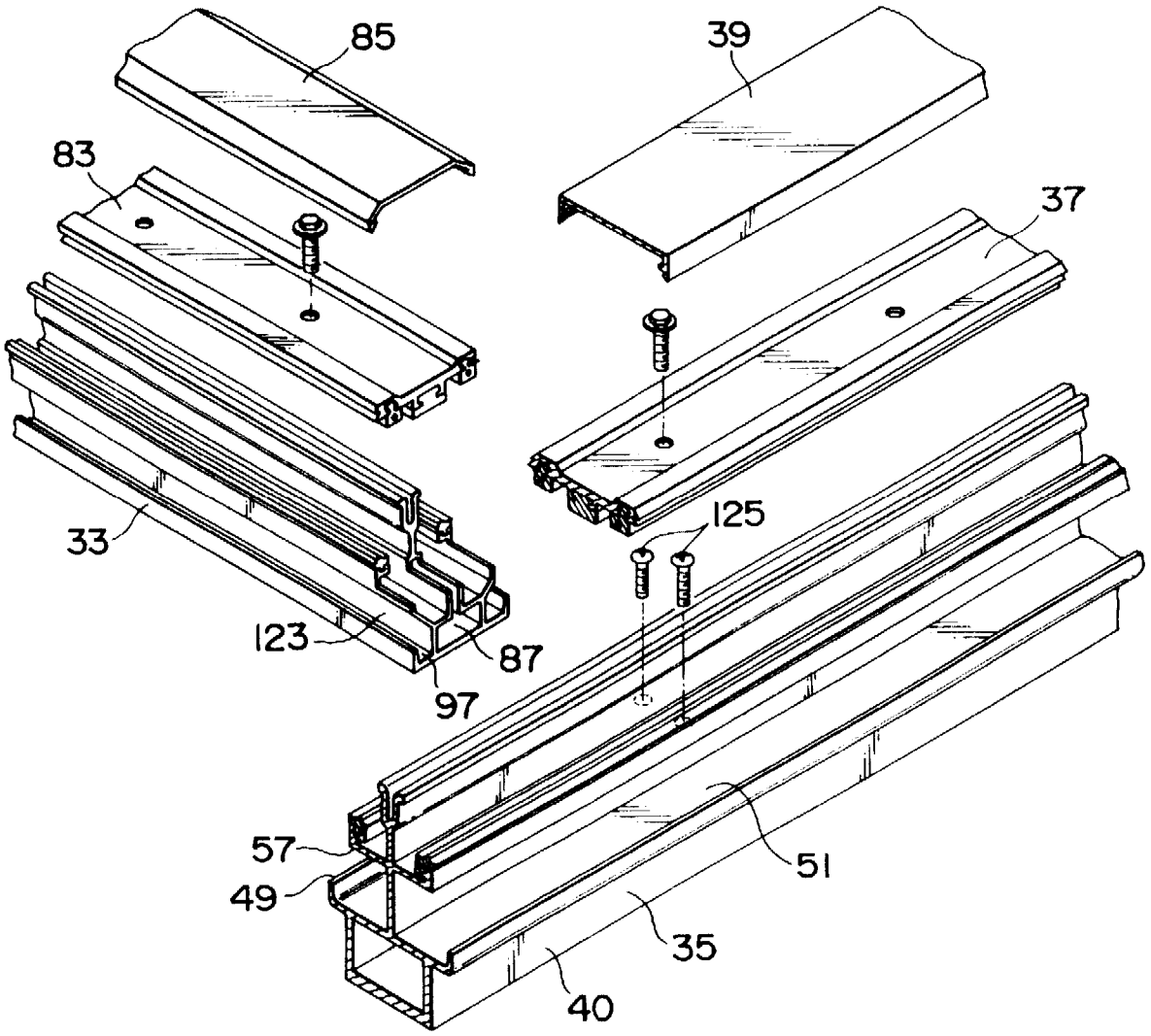
FIG. 4 is an exploded view of the sloping roof, showing how opposed purlins are butt-fitted to the opposed sides of a relevant rafter.

As shown in FIG. 4, the rafter 31 is an elongated profile preferably made of extruded aluminum. As better shown in FIG. 3, the rafter 31 is broadly comprised of a rafter body 35, a rafter presser plate 37 and a rafter cover 39. The rafter body 35 is comprised of a lower hollow base 40, of rectangular cross-section, an upper vertical rafter web 41 of the criss-cross cross-section provided on the lower hollow base 40. The lower hollow base 40 includes a pair of parallel, vertical, spaced apart side walls 43 and a top and bottom wall 45, 47 interconnected with the vertical side walls 43. The top wall 45 extends horizontally outwardly beyond the vertical side walls 43 and has its opposed edges 49, 49 turned upward to provide a pair of rafter gutters 51, 51 on opposite sides of the upper rafter web 41. The upper rafter web 41 is centrally disposed on and extending from the top wall 45 of the hollow base 40. The upper rafter web 41 has an tipper thickened portion 53 at the upper end. The tipper thickened portion 53 has a upward open groove 55 formed throughout thereof. The upper rafter web 41 further includes a pair of horizontal flanges 57 extending horizontally outwardly of the rafter web 41. These flanges 57, 57 have thickened upstanding ribs 59, 59 along their outer edges. The ribs 59 have recesses formed in their tipper surfaces to receive the tongue of a resilient gasket strip 61 used for supporting and sealing the adjacent underside of glazing panels P along their corresponding edges. The rafter web 41 and the opposed horizontal flanges 57 cooperate to partly form a pair of longitudinally extending glazing channels or pockets 63 one on each side of the rafter web 41 for receiving the sloping edge portions of the roof gazing panels P. Here in FIG. 3, dual-layer glazing panels P are shown to be used, nevertheless, single-layer glazing panels P can be used, too. In that event, the upstanding ribs 59 are made slightly higher to provide a narrower glazing pocket 63 for the single-layer panels P. It should be noted that the ribs 59 are situated within the width of the opposed gutters 51 formed by the top wall 45 and their upstanding edges 49 so as to ensure that water condensed on the inner sides of the glazing panels P can drip down the surface of the ribs 59 into the gutters 51.

The rafter presser plate 37 is made of a substantially flat elongated plate. The presser plate 37 has on its lower side one wide central groove 65 and two narrow side grooves 67 formed on the opposite sides of the central groove 65. An insulating spacer strip 69 is fitted into the central groove 65 and sealing strips 71 are fitted into the side grooves 67, 67. The presser plate 37 is placed onto the thickened upper portion 53 of the rafter body 35 with the insulating spacer strip 69 interposed therebetween and with the sealing strips 71 interposed between the presser plate 37 and the glazing panels P. Caulking compound is provided outwardly along the sealing strips 71 to further enhance the sealing effect. For securing the presser plate 37 to the thickened upper portion 53 of the rafter body 35, a plurality of cap screws, spaced apart, or other threaded fasteners 73 project downwardly into self-tapping threaded engagement with an upwardly opening central recess 55 formed in the thickened upper portion 53 of the rafter body 35. The presser plate 37 further has a pair of side notches 75 formed one on each side. The cover 39 is of a channel shape and includes two side flanges 77 and two lugs 79 formed along the lower edges of the side flanges 77. The cover 39 is pressed against the presser plate 37 so as to bring the engaging lugs 79 into snap-in engagement with the side notches 75 of the presser plate 37.

Figure 2:
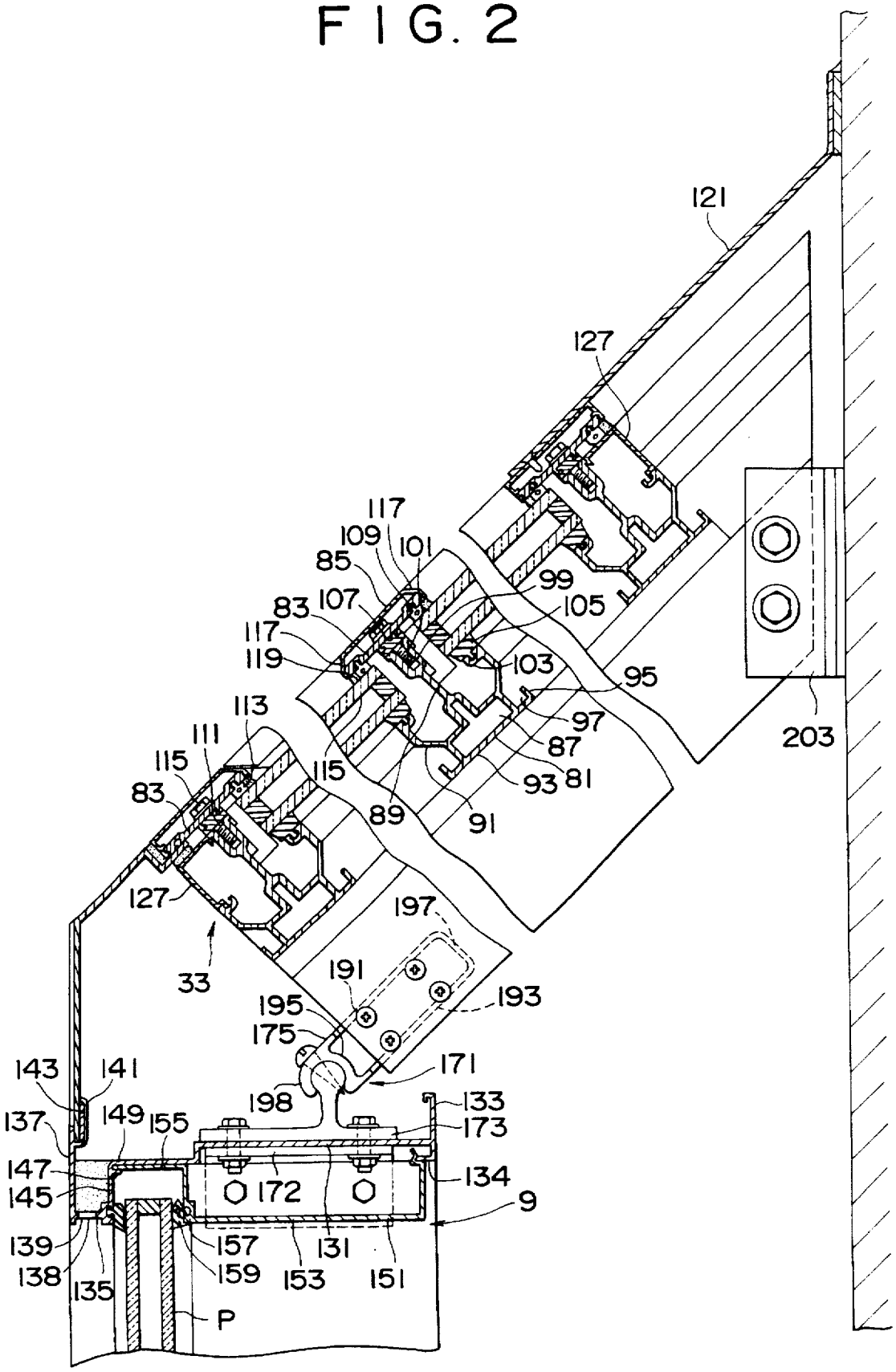
FIG. 2 is a cross-sectional view taken on line II—II of FIG. 1.

As shown in FIG. 4, the purlin 33 is also an elongated profile preferably made of extruded aluminum. As shown in FIG. 2, the purlin 33 comprises a purlin body 81, a purlin presser plate 83 and a purlin cover 85. The purlin body 81 is comprised of a polygonal hollow base 87, a central upstanding purlin web 89 centrally disposed on and extending from the hollow base 87 and a pair of opposed slant flanges 91 disposed one on each side of the central purling web 89 and extending at an angle from the corner of the hollow base 87. The bottom wall 93 of the hollow base 87 extends outwardly beyond the hollow base 85 and has a pair of upstanding flanges 95 formed along its outer edges to thus define a pair of opposed gutters 97 between the flanges 95 and the central hollow base 85. The upper purlin web 89 has an upper thickened portion 99 at the upper end. The upper thickened portion 99 has an upward opening groove 101 formed throughout. The slant flanges 91 have thickened upstanding ribs 103 along their upper edges. The ribs 103 have a recess formed in their upper surfaces for receiving the tongue of a resilient gasket strip 105 used for supporting and sealing the underside of glazing panels P along their corresponding edges. The purlin web 89 and the opposed slant flanges 91 cooperate to partly form a pair of longitudinally extending glazing channels or pockets 63 one on each side of the purlin webs 89.

The purlin presser plate 83 is made of a substantially flat elongated plate. The presser plate 83 has on its lower side one wide central groove 107 and two narrow side grooves 109 formed on the opposite sides of the central groove 107. An insulating spacer strip 111 is fitted into the central groove 107 and two sealing strips 112 are fitted into their respective side grooves 109. The presser plate 83 is placed onto the thickened upper portion 99 of the purling body 81 with the insulating spacer strip 111 interposed therebetween and with the sealing strips 113 interposed between the presser plate 83 and the outer edges of the glazing panels P. Caulking compound is provided outwardly along the sealing strips 111 to further enhance the sealing effect. For securing the purlin presser plate 83 to the thickened upper portion 99 of the purling body 81, a plurality of cap screws spaced apart or other threaded fasteners 115 project downwardly into self-tapping threaded engagement with the upwardly opening central recess 101 formed in the thickened upper portion 99 of the purlin body 81. The purlin presser plate 83 further has a pair of side notches 115 formed one on each side. The cover 83 is a channel shape and includes two side flanges 117 and lugs 119 formed along the lower edges of the respective side flanges 117. It should be noted that the covers 85 for the upper, intermediate and lower purlins 33, respectively differ from each other in cross-sectional shapes. The cover 85 of the intermediate purlin 33 has opposed flanges 117 diverged downward so as to permit rain running down the upper side of the glazing panels P to readily flow over the cover 85. The cover 85 of the upper purlin 33 is substantially identical to the cover 39 for the rafter 31 in that it has the opposed flanges 117 directed perpendicularly downward, since the covers 85 for the upper purlin 33 are substantially fully covered by an elongated flashing 121 extending throughout the sloped roof 1, as shown in FIG. 1.

Figure 5:
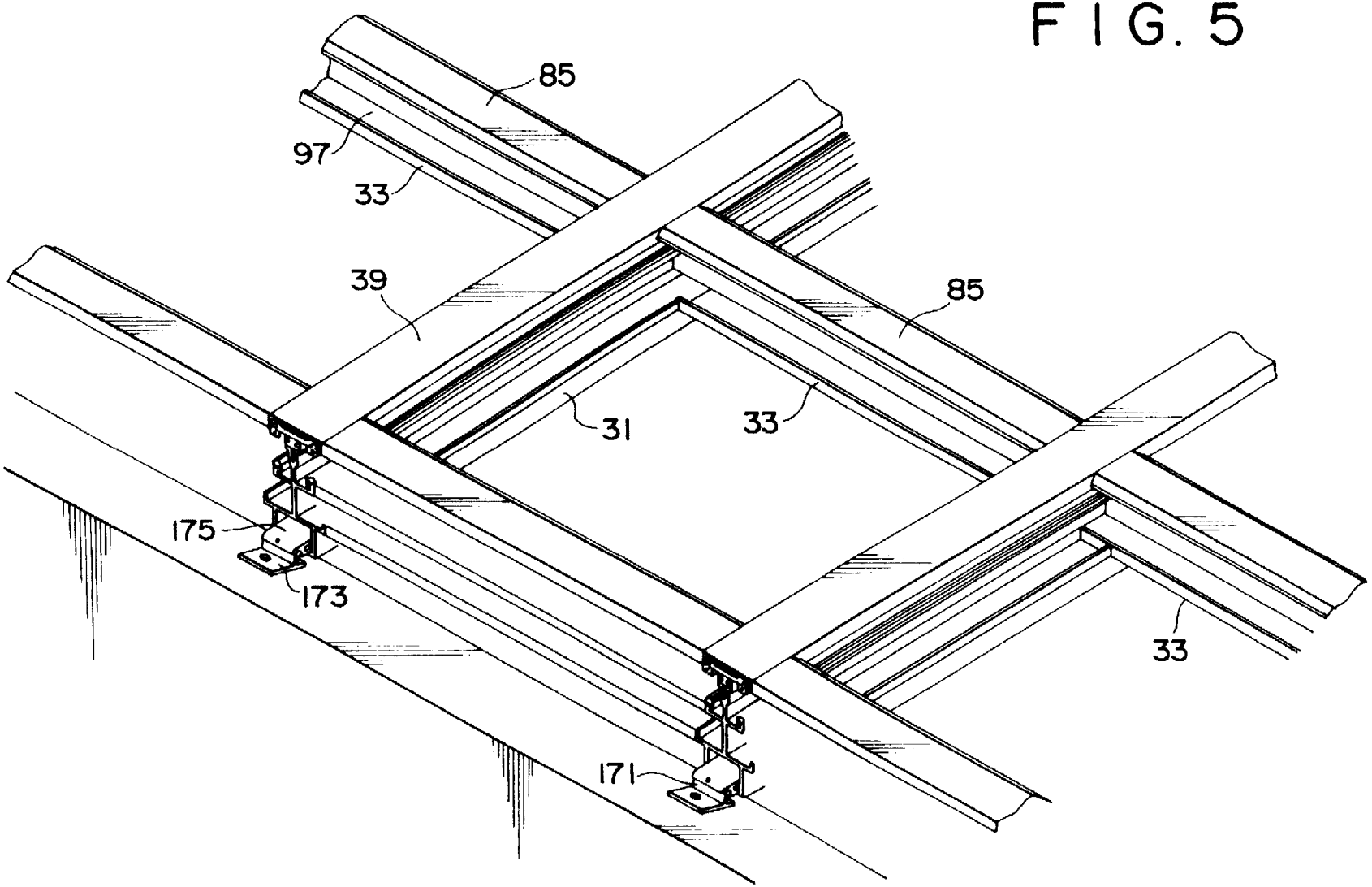
FIG. 5 is an enlarged fragmentary perspective view of the sloping roof of the solarium of FIG. 1.

As shown in FIG. 4, each end of the purlin 33 is scarfed to the corresponding side of the rafter 31, that is, each end of the purlin 33 has an upper section cutaway to thus provide a protuberant lower end section 123. As shown in FIG. 3, the lower protuberant end section 123 is fitted into the space interposed between the flanges 57 and the edges 49 of the rafter 33. The lower end section 123 of the purlin 33 is fastened to the rafter flange 57 of the rafter 31 by means of bolts 125 piercing the flange 57 and the lower end section 123. Since the lower end section 123 is situated over the rafter gutter 51, rain and condensed water collected in the purlin gutters 97 of the purlins 33 flows down to the rafter gutters 51. As shown in FIG. 2, the uppermost purlins 31 are interconnected to the rafters 31 adjacent the upper end of the rafter 31; the lowermost purlins 31 are interconnected to the rafters 31 at the lower end of the rafter 31; and an intermediate purlins 31 are interconnected to the rafters 31 in an intermediate position of the rafters 31 so that the sloped roof 1 is thus assembled as shown in FIG. 5. As shown in FIG. 2, since the upper upstanding flange 91 of the uppermost purlin 33 has no glazing panel P to support thereon, an L-shaped angle clip 127 is snapped to the upward opening groove 103 of the flange 91 and a groove formed in the thickened portion 99 of the purlin web 89. Similarly, since the lower upstanding flange 91 of the lowermost purlin 33 has no glazing panel P to support thereon, an L-shaped angle clip 127 is snapped to the upward opening groove 103 of the flange 91 and a groove formed in the thickened portion of the purlin web 89.

As better shown in FIG. 2, the head 9 is generally of a channel shaped, transverse cross-section and comprises a main plate 131, a rear flange 133 disposed along the rear edge of the main plate 131 and extending perpendicularly in opposite directions from the main plate 131, a stepped portion 135 disposed along the front edge of the main plate 131 and extending downward therefrom, and an upstanding front plate 137 disposed along the front edge of the stepped portion 135 to thus define a gutter 139 with the stepped portion 135. As thus constructed, the head 9 as a whole has a trough therein. The upstanding front plate 137 has an in-turned fin 141 adjacent the tipper edge thereof to define an upward opening groove 143 with the upper edge of the upstanding front plate. The vertical inner plate 145 of the stepped portion 135 has a rearward directed lug 147 provided adjacent to the upper edge thereof to define a groove 149 with the main plate 131. The rear flag 133 has inturned lug 135. In order to fasten the tipper edge of a front glazing panel P to the head 31, a substantially channel-shaped glazing stop 151 is used. The glazing stop 151 includes a channel-shaped main portion 153 and a front flange 155 extending forward from the front edge of the main portion 153. The lower front corner of the channel-shaped main portion 153 is provided with a recess 157. A sealing strip 159 is fitted in the recess 157. The glazing stop 151 is fastened to the head 9 by engaging the front flange 155 and the upper rear edge of the channel shaped main portion 153 of the glazing stop 151 with the groove 149 and an inward-directed fin 134, respectively of the head 9, so that the glass P is fastened between the stepped portion 135 and the glazing stop 151. The bottom of the stepped portion has a plurality of weeping holes formed at intervals longitudinally of the gutter 139 to discharge rain and water collected in the gutter 139 outward.

Figure 6:
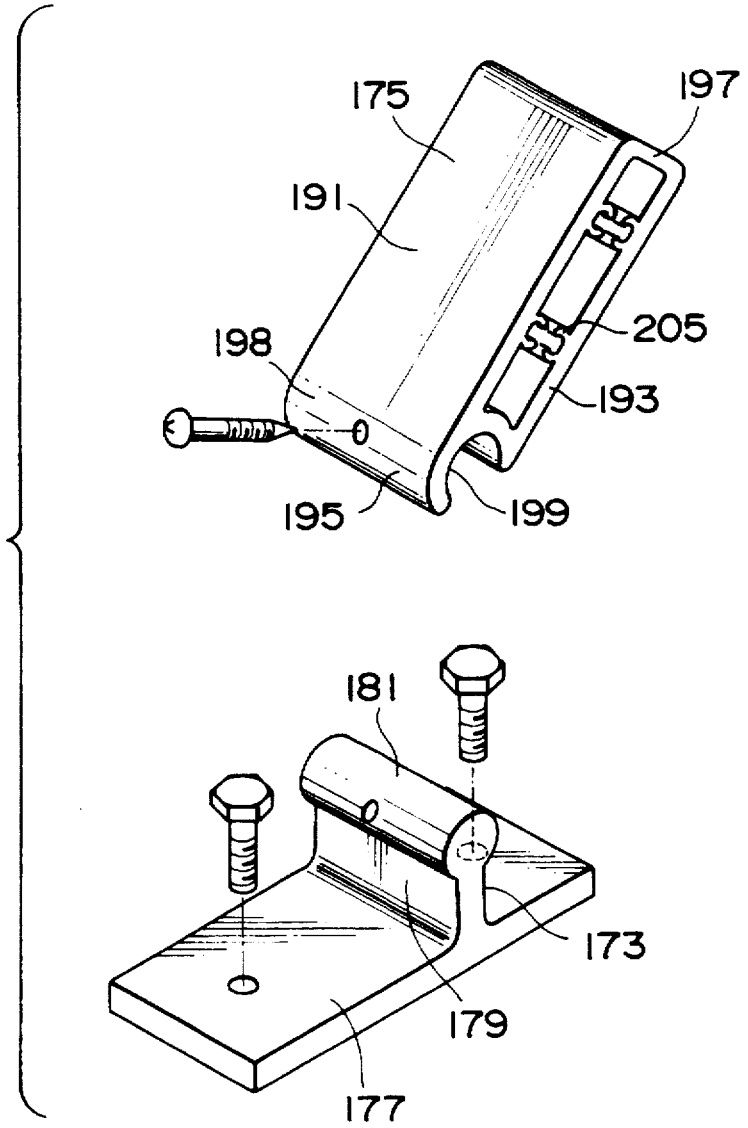
FIG. 6 is an enlarged exploded perspective view of a joining means.

As shown in FIGS. 2 and 6, the sloped roof 1 according to the present invention further has means 171 for joining the lower ends of the rafter 31 to the head 9 of the front frame 3. The joining means 171 comprises a joint support 173 fastened to the head 9 and a joint member 175 fastened to the lower end of the rafter 31 for pivotal engagement with the joint support 173. As better shown in FIG. 6, the joint support 173 has a base plate 177 and an upstanding web 179 extending perpendicularly from the base plate 177 and a circular head portion 181 formed along the upper edge of the upstanding web 179. For fastening the joint support 173 to the head 9, bolts pierce the base plate 177 of the joint support 173, the main plate 131 of the head 9 and a back plate 172 resting against the underside of the main plate 131 and are tightened by nuts. The joint member 175 is of a substantially rectangular hollow shape and comprises a pair of upper and lower plates 191, 193 and front and rear plate 195 and 197 interconnected with each other. The front plate 195 extends arcuately beyond the upper plate 191 to provide a front extension 198 and an concave recess 199. The circular head portion 181 of the joint support 173 is brought into pivotal engagement with the concave recess 199 of the joint member 175, so that the rafters 31 can be angularly adjusted relative to the head 9. The joint member 175 is made slightly less in width than the distance between the inside surface of the opposed side walls 43 of the hollow base 40 so that the joint member 175 can be fitted into the hollow base of the rafter 31 smoothly. The rear portion of the joint member 175 is secured to the opposite side walls 43, 43 of hollow base of the rafter 31 by means of threaded cap screws having elongated shanks which project into the integrally formed, hollow screw splines 205 formed transversely on and across the inner sides of the upper and lower plates 191, 193 of the joint member 175. In order to secure the joint member 175 to the joint support 173, a bolt is screwed through the front extension 198 of the joint member 175 to the circular head portion 181 of the joint support 173.

The upper end of each rafter 31 is cut slant and fastened to skeleton frame of the building by piercing a bolt through the opposed flanges of a metal clamp 203 fastened to the skeleton frame of the building and the upper end of the rafter 31 and tightening the bolt to a nut.

Since the rafters 31 and the purlins 33 are thus interconnected, rain that has accidentally infiltrated the seal between the glazing panels P and the purlin presser prates 83 of purlins 33 or water condensed on the undersides of the glazing panels P flow down the undersides of the sloped glazing panels P and collects into the purlin gutters 97, then to flow into the rafter gutters 51 and eventually flow down the rafter gutter 51 to trough defined by the head 9. The rain and water collected in the head 9 drain through the weep holes 138 of the stepped portion 135 of the head 9.

As shown in FIGS. 1 and 2, an elongated front cover 211 of a dog-legged cross-section is fitted between the lowermost purlins 33 and the heads 9 throughout the full width of the sloped roof 1 by fitting the lower edge of the cover into the groove 143 of the head 9 and clamping the upper edge of the front cover 211 between the angle clip 127 and the presser plate 83 of the lowermost purlins 33. The front cover 211 is designed to fully conceal the lower ends of the rafters 31 and the joining means 171, thereby enhancing the aesthetic aspect of the sloped roof 1 as a whole.

With the construction set forth hereinabove, the following effects result.

Since a baffle is dispensed with, the construction is simple, the manufacturing cost is less, and installing operation is simple.

Furthermore, because no consideration must be taken as to weep holes or strut holes formed in a baffle, it is very easy to change the angle of slope of the sloped roof and lateral positions of the rafters.

The whole lower ends of the rafter gutters are fully open over the trough of the head, rain that has infiltrated the seal into the sloped roof and water condensed on the undersides of the glazing panels are drained smoothly.

Still furthermore, since the orifice of the rafter gutters are fully open, one need not afraid whether dirt or soil are likely to clog the weep holes which would happen with a sloped roof equipped with a baffle.

Obviously, various modifications and variations of the present invention are possible in the light of the above teaching. It is therefore to be understood that within the scope of the appended claims the invention may be practiced otherwise than as specifically described.

What is claimed is:

1. A sloped roof and head comprising:

two or more rafters positioned substantially coplanarly at an angle, each such rafter having a rafter gutter extending longitudinally along the rafter;

two or more purlins extending between the rafters and forming a plurality of openings, each purlin having a purlin gutter extending longitudinally along the purlin;

a plurality of glazing panels fitted into said plurality of openings;

a head to support the lower end of said sloped roof, said head having a trough; and means for joining the lower ends of the rafters to said head;

wherein the purlins and the rafters are interconnected such that the purlin gutters drain into the rafter gutters, and further wherein the lower end of the rafter gutters drain into the trough of said head support, and wherein the joining means comprises a joint support fastened to the head and having a circular head portion and a joint member fastened to the lower end of the rafter and having a concave recess, the circular head portion of the joint support being brought into pivotal engagement with the concave recess of the joint member so that the rafters can be angularly adjusted relative to the head.

2. A sloped roof and head comprising:

two or more rafters positioned substantially coplanarly at an angle, each such rafter having a rafter gutter extending longitudinally along the rafter;

first and second purlins extending between the rafters and forming a plurality of openings, each purlin having a purlin gutter extending longitudinally along the purlin;

a plurality of glazing panels fitted into said plurality of openings;

a head to support the lower end of said sloped roof, said head having an internal trough;

a means for pivotally joining the lower ends of the rafters to said head that allows for a large lateral tolerance between the rafters and the head; and a bolt for fixing the pitch angle of the rafters relative to the head at the joining means;

wherein the second purlin is interconnected to the head and the purlins and the rafters are interconnected such that the purlin gutters drain into the rafter gutters, and further wherein the lower end of the rafter gutters drain into the internal trough of said head.

3. A sloped roof and head comprising:

two or more rafters positioned substantially coplanarly at an angle, each such rafter having a rafter gutter extending longitudinally along the rafter;

first and second purlins extending between the rafters and forming a plurality of openings, each purlin having a purlin gutter extending longitudinally along the purlin;

a plurality of glazing panels fitted into said plurality of openings;

a head to support the lower end of said sloped roof, said head having a trough;

a means for pivotally joining the lower ends of the rafters to said head that allows for a large lateral tolerance between the rafters and the head; and a bolt for fixing the pitch angle of the rafters relative to the head at the joining means;

wherein the second purlin is interconnected to the head and the purlins and the rafters are interconnected such that the purlin gutters drain into the rafter gutters, and further wherein the lower end of the rafter gutters drain into the trough of said head support, and wherein the trough of said head contains a plurality of weep holes.

4. A sloped roof and head comprising:

two or more rafters positioned substantially coplanarly at an angle, each such rafter having a rafter gutter extending longitudinally along the rafter;

first and second purlins extending between the rafters and forming a plurality of openings;

a plurality of glazing panels fitted into said plurality of openings having a first end and a second end;

said first and second purlins each further include a gutter extending longitudinally along the purlin, first and second openings oppositely extending longitudinally along the purlin, and a presser plate;

the first opening of said first purlin receives a clip extending longitudinally along the purlin and the second opening of said first purlin receives the first end of the glazing panels;

the first opening of said second purlin receives the second end of the glazing panels and said second opening of said second purlin receives a clip extending longitudinally along the purlin;

a head to support the lower end of said sloped roof, said head having an internal trough;

a front cover interconnected between the second purlin and the head having a first edge and a second edge, said first edge being clamped between the presser plate and the clip of the second purlin and the second edge being fastened to the head; and a means for pivotally joining the lower ends of the rafters to said head that allows for a large lateral tolerance between the rafters and the head;

wherein the purlins and the rafters are interconnected such that the purlin gutters drain into the rafter gutters, and further wherein the lower end of the rafter gutters drain into the internal trough of said head.

5. A sloped roof and head comprising:

two or more rafters positioned substantially coplanarly at an angle, each such rafter having a rafter gutter extending longitudinally along the rafter;

first and second purlins extending between the rafters and forming a plurality of openings;

a plurality of glazing panels fitted into said plurality of openings having a first end and a second end;

said first and second purlins each further include a gutter extending longitudinally along the purlin, first and second openings oppositely extending longitudinally along the purlin, and a presser plate;

the first opening of said first purlin receives a clip extending longitudinally along the purlin and the second opening of said first purlin receives the first end of the glazing panels;

the first opening of said second purlin receives the second end of the glazing panels and said second opening of said second purlin receives a clip extending longitudinally along the purlin;

a head to support the lower end of said sloped roof, said head having an internal trough;

a front cover interconnected between the second purlin and the head having a first edge and a second edge, said first edge being clamped between the presser plate and the clip of the second purlin and the second edge being fastened to the head; and a means for pivotally joining the lower ends of the rafters to said head that allows for a large lateral tolerance between the rafters and the head;

wherein the purlins and the rafters are interconnected such that the purlin gutters drain into the rafter gutters, and the lower end of the rafter gutters drain into the internal trough of said head support, and further wherein the trough of said head contains a plurality of weep holes.

* * * * *